US008456376B2

(12) United States Patent
Yang et al.

(10) Patent No.: US 8,456,376 B2
(45) Date of Patent: Jun. 4, 2013

(54) POSITION ADJUSTMENT DEVICE AND SATELLITE ANTENNA THEREOF

(75) Inventors: Lan-Chun Yang, Hsinchu (TW); Shun-Chung Kuo, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 376 days.

(21) Appl. No.: 13/004,039

(22) Filed: Jan. 11, 2011

(65) Prior Publication Data

US 2012/0081263 A1 Apr. 5, 2012

(30) Foreign Application Priority Data

Oct. 1, 2010 (TW) ..... 99133592 A

(51) Int. Cl.
*H01Q 3/02* (2006.01)

(52) U.S. Cl.
USPC ..... 343/882; 343/880

(58) Field of Classification Search
USPC ..... 343/878, 880, 881, 882, 892
See application file for complete search history.

(56) References Cited

U.S. PATENT DOCUMENTS

| | | | | |
|---|---|---|---|---|
| 4,598,297 | A * | 7/1986 | Hawkins | 343/882 |
| 4,931,809 | A * | 6/1990 | Putman et al. | 343/882 |
| 6,445,361 | B2 * | 9/2002 | Liu et al. | 343/882 |
| 6,697,026 | B1 * | 2/2004 | Hemmingsen, II | 343/760 |
| 7,046,210 | B1 * | 5/2006 | Brooker et al. | 343/880 |
| 7,164,391 | B2 * | 1/2007 | Lin et al. | 343/882 |

* cited by examiner

*Primary Examiner* — Tho G Phan
(74) *Attorney, Agent, or Firm* — Winston Hsu; Scott Margo

(57) ABSTRACT

A position adjustment device for a satellite antenna includes a holder fixed on a supporting arm of the satellite antenna, and an axis rotation bracket disposed to the holder. The holder has a first connecting part. The axis rotation bracket rotates around a focal axis of the satellite antenna and comprises a bracket body where a low noise block down-converter with integrated feed (LNBF) of the satellite antenna is fixed, an arc slot disposed to the bracket body wherein a circular center thereof is on the focal axis, and a first positioning element passing through the first connecting part and the arc slot, for connecting the axis rotation bracket to the holder, and positioning the holder and the axis rotation bracket along the arc slot relatively.

18 Claims, 7 Drawing Sheets

POSITION ADJUSTMENT DEVICE AND SATELLITE ANTENNA THEREOF

BACKGROUND OF THE INVENTION

1. Field of the Invention

The present invention relates to a position adjustment device and satellite antenna thereof, and more particularly, to a position adjustment device and satellite antenna thereof capable of comprehensive and high-precision adjustment.

2. Description of the Prior Art

Satellite communication technology has advantages of wide coverage area and long distance linking, which is widely used in many applications, such as in satellite broadcasts or communication systems. Thus, wherever you are, even on the ocean or in the desert, the satellite signal may be received by a corresponding antenna. Please refer to FIG. 1. FIG. 1 is a satellite communication receiving system 10 in the prior art. The satellite communication receiving system 10 includes a dish antenna 102, a Low Noise Block Down-converter with Integrated Feed (LNBF) 104, and a supporting arm 106. In the satellite communication receiving system 10, the parabolized dish antenna 102 reflects the satellite signals to the LNBF 104 located on a focal point of the dish antenna 102. The satellite signal is down converted to an intermediate frequency (IF) signal by the LNBF, and the IF signals are fed to a rear satellite receiver via coaxial cables for further processing.

The abovementioned parts of the satellite communication receiving system 10 are assembled manually. For instance, the LNBF 104 is usually set on the supporting arm 106 to receive the reflected satellite signals. Generally, in a multiple-satellites-on-one-dish configuration, a number of the LNBFs 104 may be attached to the supporting arm 106. In such a situation, the LNBF 104 located at the focal point of the dish antenna 102 receives the best satellite signals. However, since the LBFN 104 is fixed on the supporting arm 106, accurate positioning is difficult. If the LNBF 104 can not be adjusted to an optimized position, the reception may degrade due to directional sensitivity of the antenna. The situation is aggravated especially in the multiple-satellites-on-one-dish configuration. If relative positions of the dish antenna 102 and the LNBFs 14 are challenging to adjust, no LNBF 14 can maximize its reception efficiency. This may compromise the overall reception efficiency of the satellite communication system 10.

SUMMARY OF THE INVENTION

It is therefore a primary objective of the present invention to provide a position adjustment device and satellite antenna thereof.

The present invention discloses a position adjustment device for a satellite antenna, comprising a holder, fixed on a supporting arm of the satellite antenna, comprising a first connecting part; and an axis rotation bracket, disposed to the holder, rotating around a focal axis of the satellite antenna, comprising a bracket body, wherein a low noise block down-converter with integrated feed (LNBF) of the satellite antenna is fixed on the bracket body; an arc slot, disposed to the bracket body, wherein a circular center thereof is on the focal axis; and a first positioning element, passing through the first connecting part and the arc slot, for connecting the axis rotation bracket to the holder, and positioning the holder and the axis rotation bracket along the arc slot relatively.

The present invention further discloses a satellite antenna, comprising a satellite dish, comprising a focal axis; a LNBF; a supporting arm; and a position adjustment device, comprising a holder, fixed on the supporting arm, comprising a first connecting part; and an axis rotation bracket disposed to the holder, rotating around a focal axis of the satellite antenna, comprising a bracket body, wherein the LNBF is fixed on the bracket body; a arc slot, disposed on the bracket base, wherein a circular center thereof is on the focal axis; and a first positioning element, passing through the first connecting part and the arc slot, for connecting the axis rotation bracket to the holder, and positioning the holder and the axis rotation bracket along the arc slot relatively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
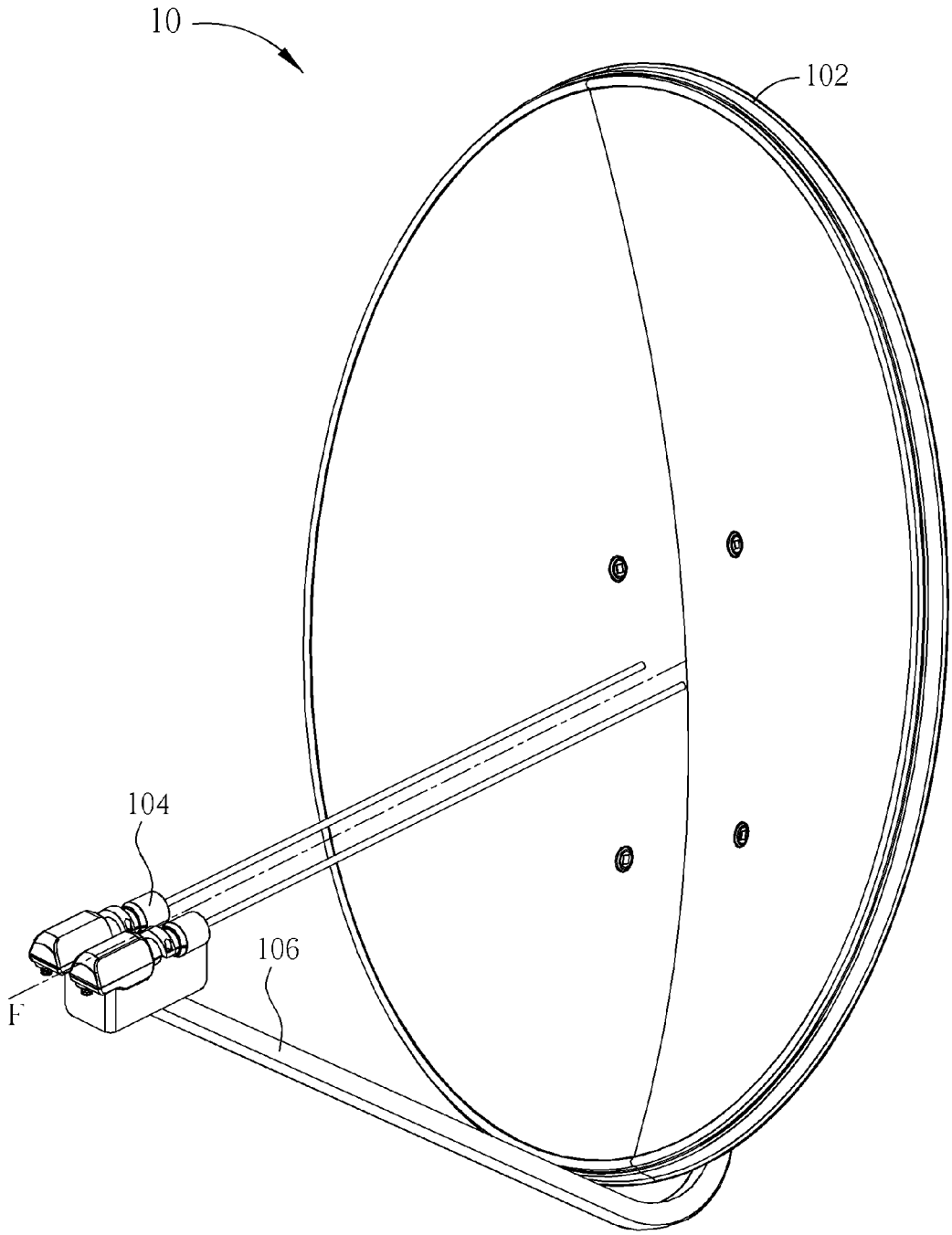
FIG. 1 PRIOR ART
FIG. 1 is a schematic diagram of a conventional satellite antenna system.
Figure 2:
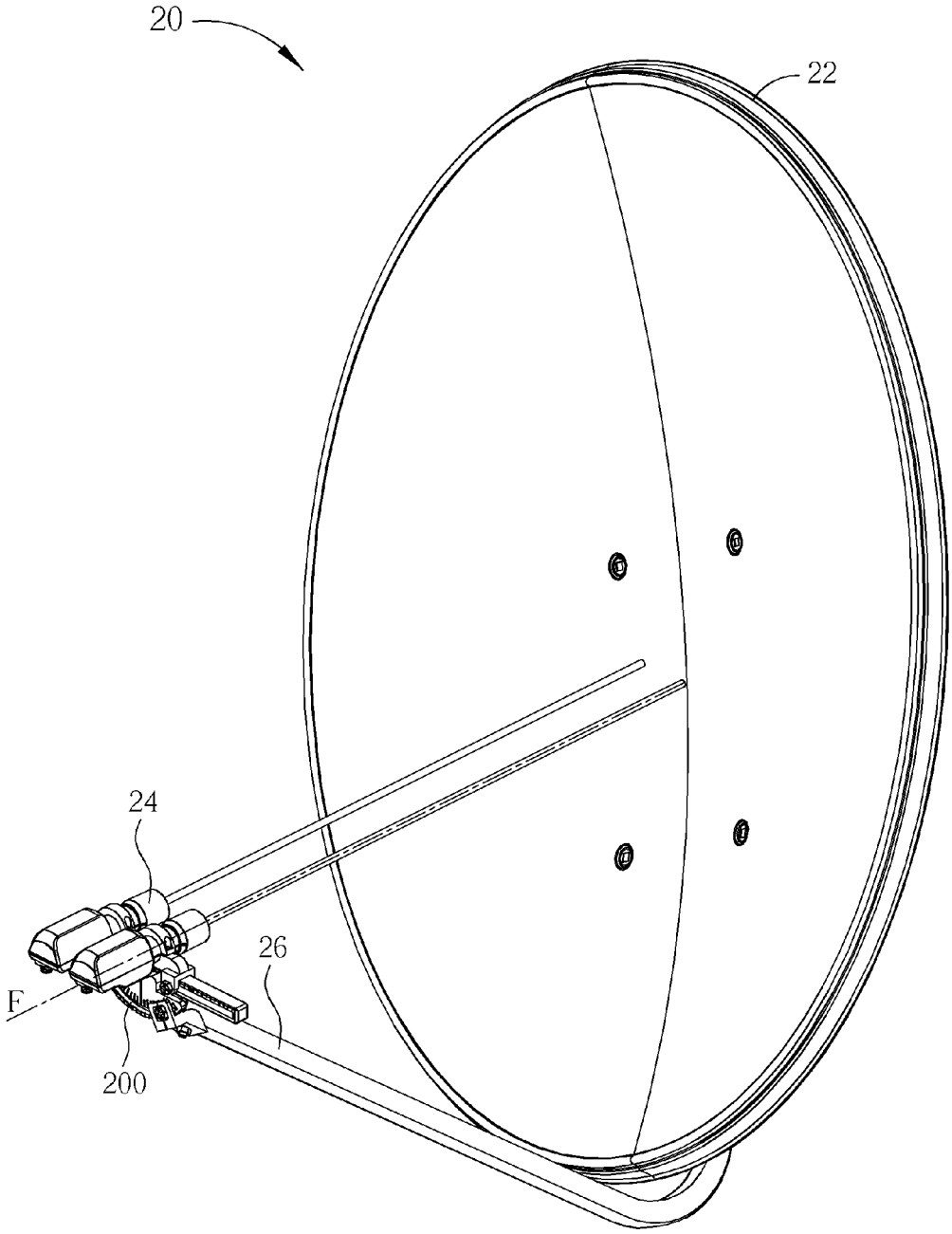
FIG. 2 is a schematic diagram of an exemplary satellite antenna system according to the present invention.
Figure 3:
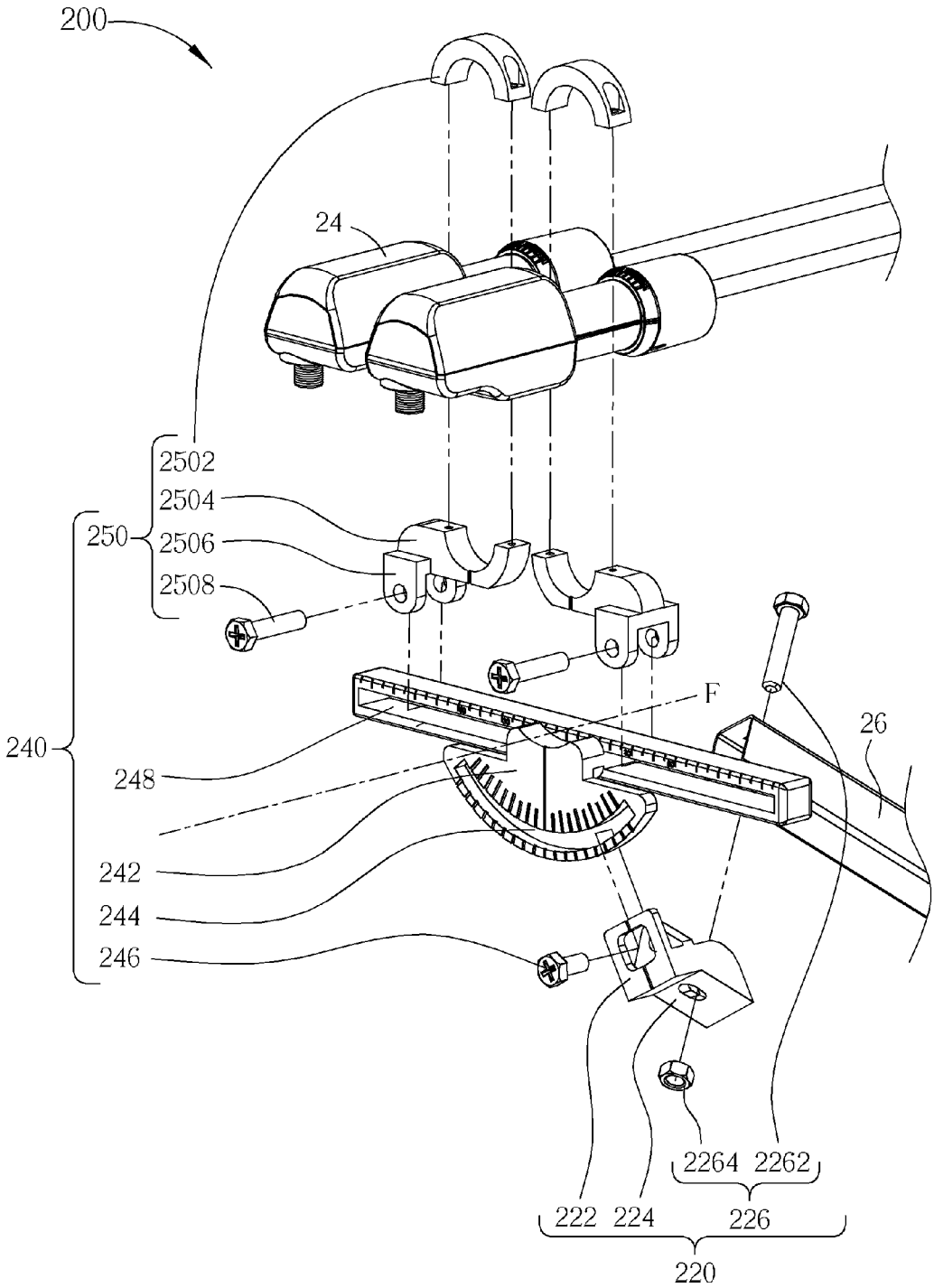
FIG. 3 is an exploded diagram of an embodiment of a position adjustment device according to the present invention.
Figure 4:
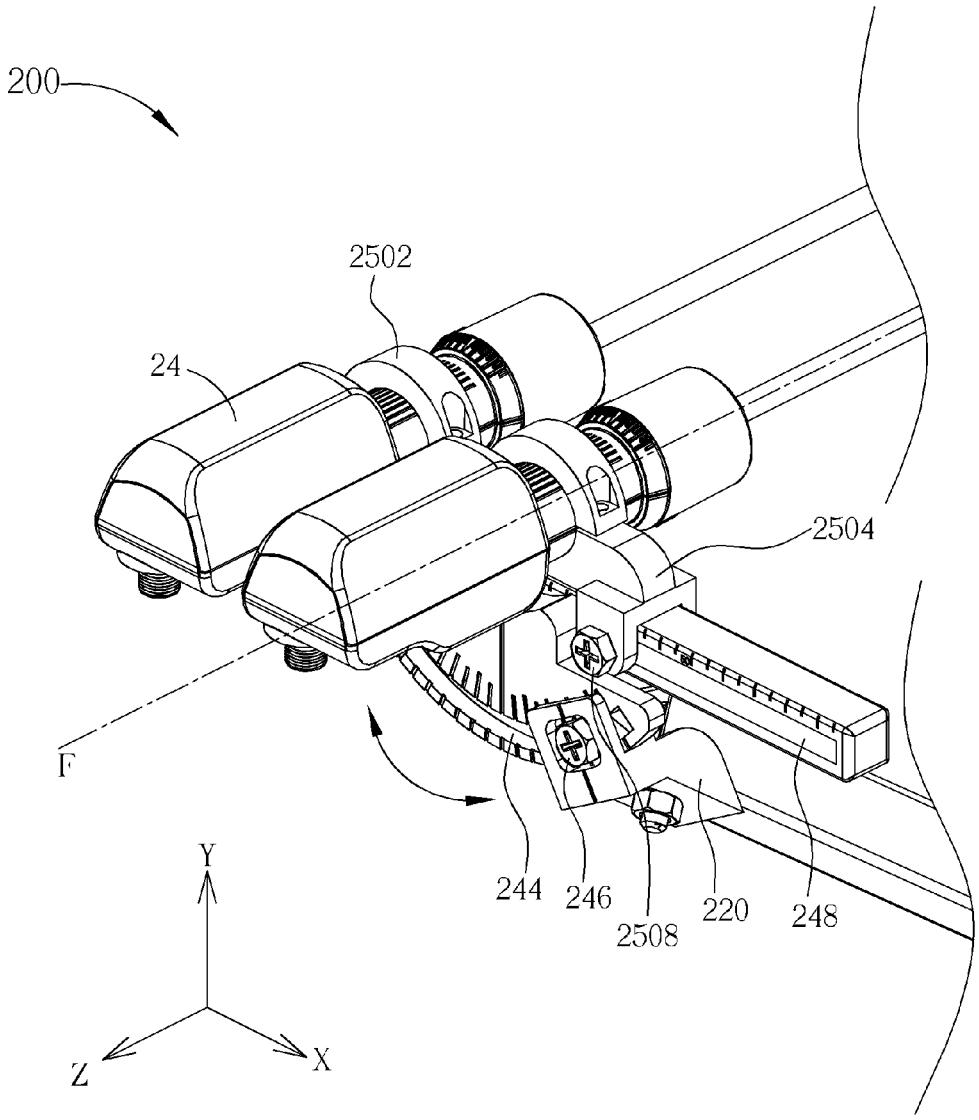
FIG. 4 is an assembly diagram of the position adjustment device in FIG. 3.

Please refer to FIG. 2 to FIG. 4. FIG. 2 is a schematic diagram of an exemplary satellite communication system 20 according to the present invention. FIG. 3 illustrates an exploded diagram of a position adjustment device 200. FIG. 4 is an assembly diagram of the position adjustment device 200 in FIG. 3. Please note that the present invention can be applied to a satellite communication system with one or more low noise block down-converter with integrated feeds (LNBFs). The description below illustrates a satellite communication system having two LNBFs, and is not limited hereinafter. As shown in FIG. 2, the satellite communication system 20 includes a dish antenna 22, an LNBF 24, a supporting arm 26 and the position adjustment device 200. The dish antenna 22 has a focal axis F. The position adjustment device 200 is disposed on the supporting arm 26. The LNBF 24 is disposed through the position adjustment device 200 for receiving satellite signals reflected by the dish antenna 22. Therefore, according to the present invention, the position adjustment device 200 provides a sophisticated adjustment of relative positions of the LNBF 24 and the dish antenna 22.

The position adjustment device 200 includes a holder 220 and an axis rotation bracket 240. The holder 220 is fixed on the supporting arm 26 and includes a first connecting part 222, a second connecting part 224 and a fixing element 26. The first connecting part 222 and the second connecting part 224 both have a through-hole. The fixing element 226 includes a bolt 2262 and a nut 2264. The bolt 2262 and the nut 2264 are a compatible screw pair. The fixing element 226 is used for connecting the holder 220 to the supporting arm 26. For example, the bolt 2262 passes through the second connecting part 224 and a third connecting part (not shown in FIG. 2 to FIG. 4) of the supporting arm 26 to connect the holder 220 to the supporting arm 26. The axis rotation bracket 240 is disposed in the holder 220 and operable to rotate around the focal axis F. The axis rotation bracket 240 includes a bracket body 242, an arc slot 244 and a first positioning element 246. As shown in FIG. 3, the LNBF 24 is fixed on the bracket body 242. The arc slot 244 is disposed in the bracket body 242, and a circular center of the arc slot 244 is on the focal axis F. The first positioning element 246 passes through the first connecting part 222 and the arc slot 244 to connect the axis rotation bracket 240 to the holder 220, and positions the holder 220 and the axis rotation bracket 240 along the arc slot 244 relatively. In other words, the first positioning element 246 can slide along the arc slot 244 to adjust positions of the axis rotation bracket 240 and the holder 220. Consequently, when the first positioning element 246 changes the position thereof by sliding along the arc slot 244, the axis rotation bracket 240 rotates around the circular center of the arc slot 244. In such a situation, the axis rotation bracket 240 adjusts the position thereof by rotating around the focal axis F. Therefore, when adjusting relative positions of the LNBF 24 and satellite dish 22, with the position adjustment device 200, the LNBF 24 can rotate around the focal axis F, so as to locate an optimal reception position.

Please continue to refer to FIG. 3 and FIG. 4, the axis rotation bracket 240 further includes a sliding slot 248 and a sliding base 250. The sliding slot 248 is disposed to the bracket body 242. The sliding base 250 slices along the sliding slot 248 and is disposed around the bracket body 242 to fix the LNBF 24 on the bracket body 242. Preferably, the sliding base 250 slides along a direction vertical to the focal axis F in the sliding slot 248. The sliding base 250 includes an upper bracket 2502, a sliding body 2504, a fourth connecting part 2506 and a second positioning element 2508. The sliding body 2504 fastens the LNBF 24 cooperatively with the upper bracket 2502. The fourth connecting part 2506 is disposed on the sliding body 2504. The second positioning element 2508 passes through the fourth connecting part 2506 and the sliding slot 248 to connect the sliding base 250 to the bracket body 242. The second positioning element 2508 positions the sliding base 250 and the bracket body 242 along the sliding slot 248 relatively. Namely, when the second positioning element 2508 changes the position thereof in the sliding slot 248, the position of the LNBF 24 changes correspondingly. Therefore, with the sliding slot 248 and the sliding base 250, the bracket body 242 further adjusts the relative positions of the LNBF 24 and the axis rotation bracket 240.

On the other hand, the position adjustment device 200 fastens the LNBF 24 via the upper bracket 2502 and the sliding body 2504, and thus a distance between the LNBF 24 and the satellite dish 22 can be adjusted by changing a fixing position of the LNBF 24.

Figure 5:
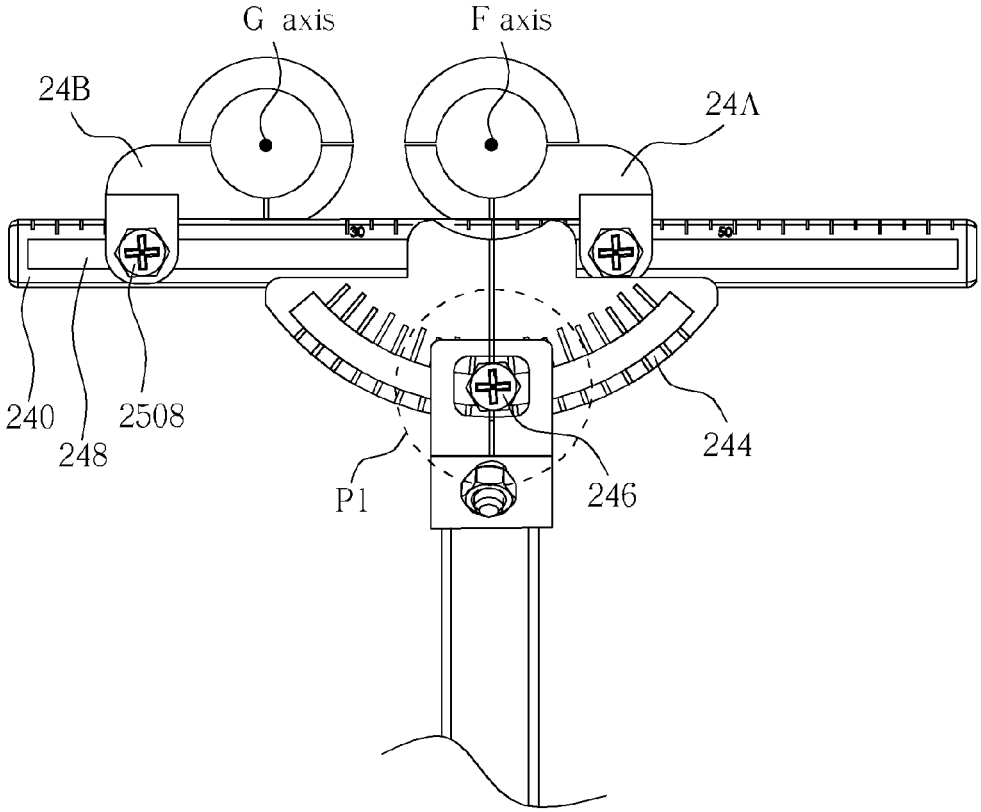
FIG. 5 and FIG. 6 are schematic diagrams of rotary position adjustment of a low noise block down-converter with integrated feed (LNBF).
Figure 6:
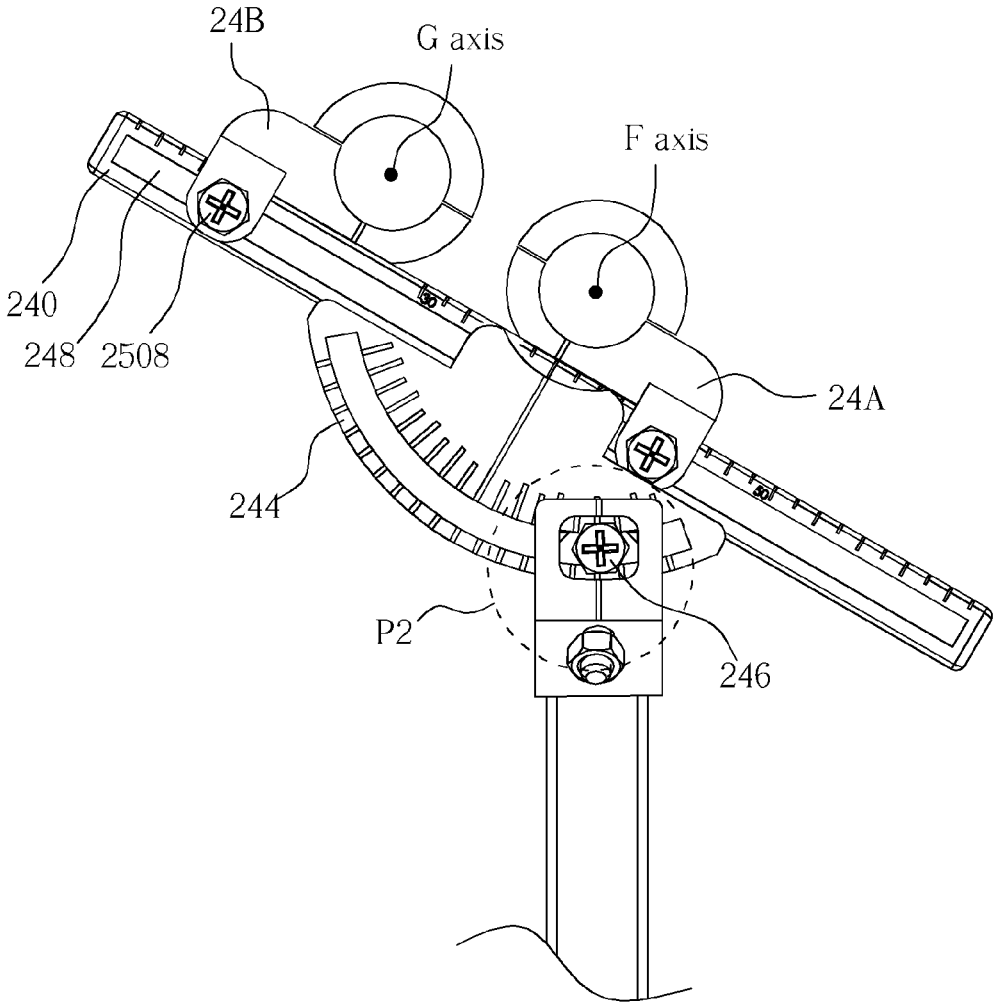
Figure 7:
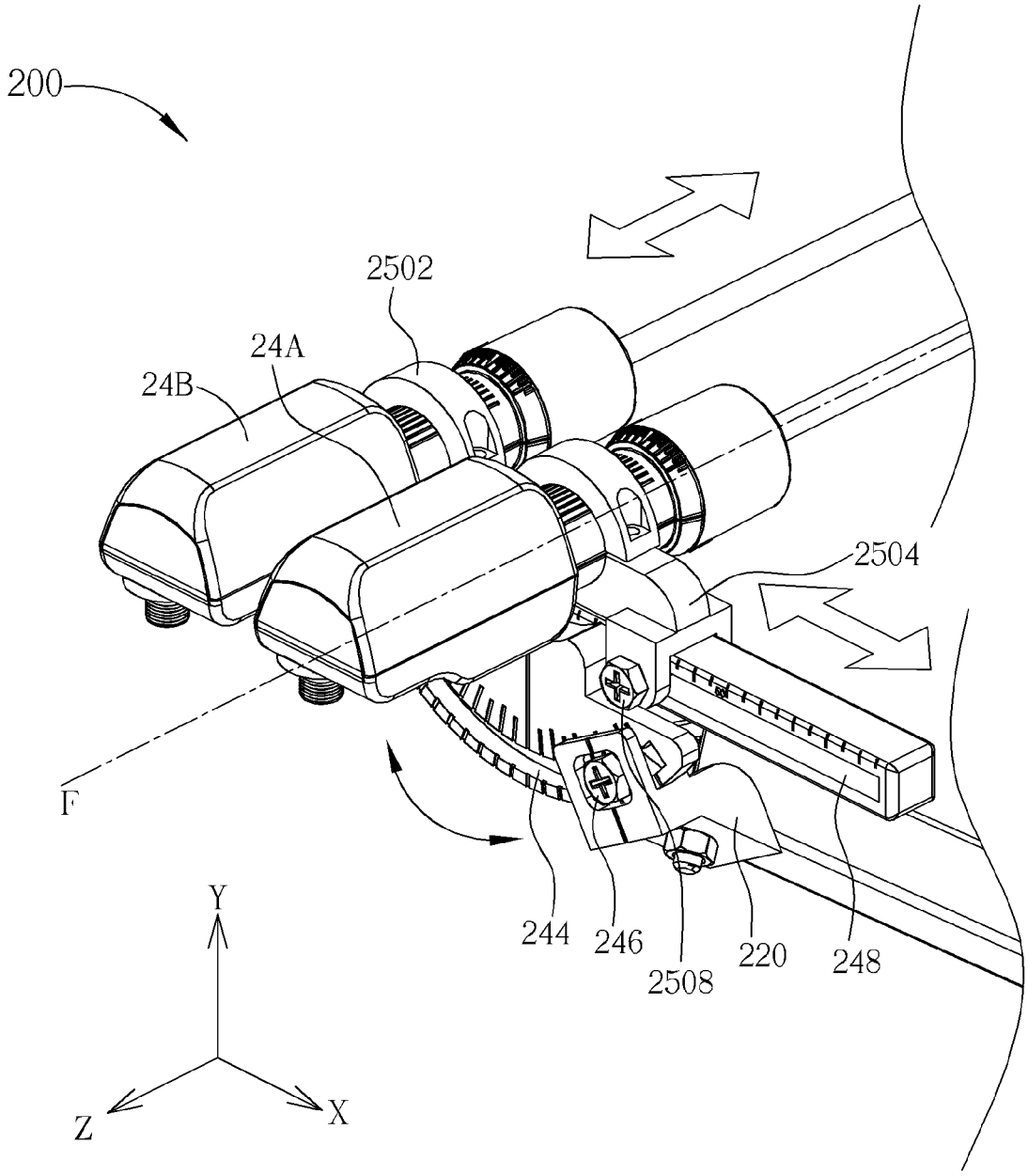
FIG. 7 is a schematic diagram of shift position adjustment of a LNBF.

Please refer to FIG. 5 and FIG. 6 for detailed description of operations of the position adjustment device 200 in FIG. 3. FIG. 5 and FIG. 6 illustrate schematic diagrams of rotary position adjustment of the LNBF 24. Assume the satellite antenna system 20 uses a LNBF 24A and a LNBF 24B to receive the satellite signals. After the holder 220 connects to the supporting arm 26, the LNBF 24A is on the focal axis F of the satellite dish 22, and the LNBF 24B is on an axis G. Next, positions of the LNBF 24A and 24B are adjusted by rotating the position adjustment device 200. For example, when the position of the first positioning element 246 is adjusted from P1 to P2, considering the axis rotation bracket 240 rotates around the focal axis F, the LNBF 24A stays on the focal axis F. Namely, however the axis rotation bracket 240 rotates, the position of the LNBF 24A does not change. The LNBF 24B rotates around the focal axis F correspondingly according to a rotating angle of the axis rotation bracket 240. Furthermore, please refer to FIG. 7, which is a schematic diagram of shift position adjustment of the LNBF 24. The position of the sliding base 250 is changed by adjusting a fixing position of the second positioning element 2508 in the sliding slot 248 in order to adjust the LNBF 24A or the LNBF 24B along a direction X, so as to adjust distances between the LNBFs and the focal axis F. In addition, the LNBF 24A or the LNBF 24B can be adjusted along direction Z by changing a position of the LNBF 24 fixed by the upper bracket 2502 and the sliding body 2504, so as to adjust a distance between the LNBF 24 and the satellite dish 22. In short, with the position adjustment device 200, signal-receiving directions of all LNBFs in the satellite antenna system 20 can be adjusted flexibly and positioned most precisely to receive maximum satellite signals.

Noticeably, the satellite antenna system 20 is one embodiment of the present invention. Those skilled in the art can make modifications and alterations accordingly. For example, as shown in FIG. 3, the holder 220 is connected to the supporting arm 26 through the second connecting part 224 and the fixing element 226, and not limited hereinafter. For example, the holder 220 and the supporting arm 26 can be a monocoque construction. The holder 220 can also connect to the supporting arm 26 via an axle. Consequently, the axle manages to rotate the holder 220 and serves as a connection. In addition, the first positioning element 246 and the second positioning element 2508 can be implemented with a screw pair corresponding to a bolt and a nut, or any other detachable fastening devices. The bracket 2502 can be fixed on the sliding body 2504 by screwing, clipping, welding, or other detachable fastening methods, to firmly fasten the LNBF 24.

To sum up, the present invention provides comprehensive adjustments for positioning, such as rotary, lateral and forward-and-backward adjustments around a focal axis, such that an LNBF can be accurately adjusted to a proper receiving direction, so as to receive satellite signals reflected by a satellite dish. More importantly, in a multiple-satellites-on-one-dish configuration, the present invention provides the most flexible and rapid position adjustment, to ensure all LNBFs are at the best receiving positions to achieve optimal signal reception.

Those skilled in the art will readily observe that numerous modifications and alterations of the device and method may be made while retaining the teachings of the invention.

What is claimed is:

1. A position adjustment device for a satellite antenna, comprising:

a holder, fixed on a supporting arm of the satellite antenna, comprising:

a first connecting part; and an axis rotation bracket, disposed on the holder, rotating around a focal axis of the satellite antenna, comprising:

a bracket body, wherein a low noise block down-converter with integrated feed (LNBF) of the satellite antenna is fixed on the bracket body;

an arc slot, disposed in the bracket body, wherein a circular center thereof is on the focal axis; and a first positioning element, passing through the first connecting part and the arc slot, for connecting the axis rotation bracket to the holder, and positioning the holder and the axis rotation bracket along the arc slot relatively.

2. The position adjustment device of claim 1, wherein the LNBF is disposed on the focal axis.

3. The position adjustment device of claim 1, wherein the supporting arm and the holder are a monocoque construction.

4. The position adjustment device of claim 1, wherein the axis rotation bracket further comprises:

a sliding slot, disposed in the bracket body; and a sliding base, disposed in the bracket base, slidable along the sliding slot, for fixing the LNBF on the bracket body.

5. The position adjustment device of claim 4, wherein the sliding base comprises:

an upper bracket;

a sliding body, for fixing the LNBF cooperatively with the upper bracket;

a fourth connecting part, disposed on the sliding body; and a second positioning element, passing through the fourth connecting part and the sliding slot, for connecting the sliding base to the bracket body, and positioning the sliding base and the bracket body along the sliding slot relatively.

6. The position adjustment device of claim 4, wherein the sliding base slides along a direction vertical to the focal axis in the sliding slot.

7. The position adjustment device of claim 1, wherein the first positioning element slides along the arc slot to position the holder and the axis rotation bracket relatively.

8. The position adjustment device of claim 7, wherein the axis rotation bracket rotates around the focal axis when the first positioning element slides along the arc slot.

9. A satellite antenna, comprising:

a satellite dish, comprising:

a focal axis;

a low noise block down-converter with integrated feed (LNBF);

a supporting arm; and a position adjustment device, comprising:

a holder, fixed on the supporting arm, comprising:

a first connecting part; and an axis rotation bracket disposed on the holder, rotating around a focal axis of the satellite antenna, comprising:

a bracket body, wherein the LNBF is fixed on the bracket body;

an arc slot, disposed in the bracket body, wherein a circular center thereof is on the focal axis; and a first positioning element, passing through the first connecting part and the arc slot, for connecting the axis rotation bracket to the holder, and positioning the holder and the axis rotation bracket along the arc slot relatively.

10. The satellite antenna of claim 9, wherein the LNBF is disposed on the focal axis.

11. The satellite antenna of claim 9, wherein the holder further comprises a fixing element for connecting the holder to the supporting arm.

12. The satellite antenna of claim 11, wherein the holder further comprises a second connecting part, wherein the fixing element passes through the second connecting part and a third connecting part of the supporting arm, to connect the holder to the support arm.

13. The satellite antenna of claim 9, wherein the supporting arm and the holder are a monocoque construction.

14. The satellite antenna of claim 9, wherein the axis rotation bracket further comprises:

a sliding slot, disposed in the bracket body; and a sliding base, disposed on the bracket body, slidable along the sliding slot, for fixing the LNBF on the bracket body.

15. The satellite antenna of claim 14, wherein the sliding base comprises:

an upper bracket;

a sliding body, for fixing the LNBF cooperatively with the upper bracket;

a fourth connecting part, disposed on the sliding body; and a second positioning element, passing through the fourth connecting part and the sliding slot, for connecting the sliding base to the bracket base, and positioning the sliding base and the bracket body along the sliding slot relatively.

16. The satellite antenna of claim 14, wherein the sliding base slides along a direction vertical to the focal axis in the sliding slot.

17. The satellite antenna of claim 9, wherein the first positioning element slides along the arc slot to position the holder and the axis rotation bracket relatively.

18. The satellite antenna of claim 17, wherein the axis rotation bracket rotates around the focal axis when the first positioning element slides along the arc slot.

* * * * *